United States Patent [19]

Mathis

[11] Patent Number: 4,658,721

[45] Date of Patent: Apr. 21, 1987

[54] METHOD AND APPARATUS FOR HOT FOIL EMBOSSING A WORKPIECE

[76] Inventor: Walter Mathis, Feldheim 1, CH-6312 Steinhausen, Fed. Rep. of Germany

[21] Appl. No.: 740,172

[22] Filed: May 31, 1985

[30] Foreign Application Priority Data

Jun. 6, 1984 [DE] Fed. Rep. of Germany ..... 3421029

[51] Int. Cl.[4] ..... B41F 17/20

[52] U.S. Cl. ..... 101/9; 101/32; 101/114; 101/129

[58] Field of Search ..... 101/9, 32, 27, 31, 35, 101/41, 114, 129; 156/213, 215, 443

[56] References Cited

U.S. PATENT DOCUMENTS

| | | | |
|---|---|---|---|
| 203,395 | 5/1878 | Whittaker | 101/114 X |
| 1,238,229 | 8/1917 | Weiler | 101/35 X |
| 2,014,372 | 9/1935 | Brickell, Jr. | 101/114 |
| 2,057,788 | 10/1936 | Pannier, Jr. et al. | 101/114 X |
| 2,138,350 | 11/1938 | McChesney | 101/9 |
| 2,356,951 | 8/1944 | Runton | 101/27 X |
| 2,684,775 | 7/1954 | Von Hofe | 101/41 X |
| 2,748,696 | 6/1956 | Murray | 101/41 |
| 2,941,570 | 6/1960 | Plym | 156/213 X |
| 3,382,795 | 5/1968 | Downs | 101/31 X |

*Primary Examiner*—Clifford D. Crowder
*Attorney, Agent, or Firm*—Max Fogiel

[57] ABSTRACT

In a procedure for dry printing of a workpiece through application of a hot embossing foil 5 and embossing die 8 as well as with application of heat, pressure, and time, workpiece 1 and embossing die 8 are moved relatively up to each other, held in contact with intermediate clamping of hot embossing foil 5, and heat thereby transferred. Hot embossing foil 5 is thereby adhered to the workpiece according to embossing die 8 and, after a cooling time, detached from workpiece 1 with the exception of printed image 2. To print differently shaped surfaces 2 of workpieces 1, embossing die 8 is brought into contact with workpiece 1 through progressive engagement over entire die surface 11, with embossing die 8, at least in the region of die surface 11, being given a form according to the shape of the workpiece.

10 Claims, 7 Drawing Figures

METHOD AND APPARATUS FOR HOT FOIL EMBOSSING A WORKPIECE

The invention relates to a procedure for dry printing of a workpiece with the features as specified in claim 1. A device for execution of the procedure is simultaneously indicated.

The invention can be used both for printing of rigid bodies, i.e. those that are flexible only within the domain of elastic material deformation. Bodies of flexible design, e.g. blown plastic bottles, especially for the cosmetic industry, however, can also be printed to special advantage by the procedure according to the invention. It thereby does not matter how the surface of the workpiece to be printed is individually shaped; this surface may notably be designed even, convex-round, convex-oval, or also concave.

The indicated procedure, however, is also suitable for printing of any other materials, e.g. metal, wood, glass, ceramics, etc. by embossing, if a suitable bonding agent is used between the surface to be printed and the embossing foil. Such an bonding agent can be applied to the workpiece to be printed before or after embossing. In particular, the bonding agent can be arranged on the embossing foil or also applied to the surface of the workpiece to be printed during embossing via intermediate insertion of a separate foil.

The hot embossing foil printing procedure referred to herein is a dry printing procedure whereby the hot embossing foil is adhered or melted on to the surface to be printed. The hot embossing foil itself consists of a carrier strip, a separating film, advisably a protective lacquer, the ink film proper, which frequently contains an additional metal film, and the plastic adhering or connecting film to the surface to be printed. All other films apart from the carrier strip are applied to the surface to be printed during the printing process and, after appropriate cooling, stripped off the hot embossing foil or carrier strip where they are adhered or connected to the surface to be printed.

In hot embossing technology, two procedures are so far essentially used, i.e. the lifting procedure, on the one hand, and the unrolling procedure, on the other (Oeser company publication "Embossing Foil Printing, Surface Refinement Technology for Plastics" 1979, pp. 15–21; German Patent No. 14 49 637). In the lifting procedure, the workpiece is retained and the embossing die moved in stroke-like manner. The embossing die represents a rigid body and generally consists of metal, especially brass or steel. Also used are embossing dies which exhibit a silicone die element on a rigid metal basic element. Depending on application, the silicone overlay exhibits a material thickness which can range between 0.8 and 4 mm. The die element compressible within the frame of its silicone material elasticity serves to compensate tolerances on the surface of the workpiece to be printed. These tolerances can be understandably better compensated, the thicker is the silicone overlay. On the other hand, heat transfer from the metal basic element to the silicone overlay is impaired with increasing material thickness. Limits are thus here imposed. The embossing die is fitted on a so-called heating head in which heating cartridges are frequently used to liberate the necessary heat, which is then transferred via the heating head and metal basic element of the embossing die by thermal conduction. Such a system is very sluggish. The die surface of the embossing die attains its working temperature after around half an hour, so that the printing process can then be initiated.

In the unrolling procedure, which is used especially for surface coating of cylindrical or slightly conical parts, such as lipstick cases, cream jars, and the like, the workpiece is moved and unrolled on the embossing die. In its length, the embossing die corresponds to embossing development. An appreciable contact pressure must also thereby be attained so that the necessary temperature is attained within the interval of time available for the unrolling process. The procedure is problematic insofar as neither a controllable dwell time, on the one hand, for application of heat nor a specific cooling time for hardening of embossed films is available. The procedures, however, confers the advantage that, during the unrolling procedure, a bubble-free connection between adhered printing film and workpiece is attained.

Especially problematic is printing of flexible, i.e. deformable, hollow bodies, i.e. polyethylene bottles as used in the cosmetic industry for filling of different liquid or pasty products. The plastic bottle must itself thereby be flexible and compressible to allow extraction of its contents during use. Such deformable hollow bodies have quite different shape from a cylindrical cross-section to flat-oval, whereby the surface of the workpiece to be printed may be bent not only in one direction or plane. Such hollow bodies are printed with the aid of a split mould. The lower part of the mould is fixed and forms a bed for holding of around half of the bottle. The mould includes a moving upper part so that the bottles can be held and fixed between upper and lower parts. The hot embossing foil runs between upper and lower parts of the bottle. The upper part has an opening in which the embossing die is arranged and thereby rigidly connected with the upper part. The upper part of the mould is seated on the so-called heating head in which heat is liberated and conducted downwards, i.e. to the embossing die but not to the upper part of the mould. The upper part of the mould must therefore consist of thermally insulating material. After insertion of the bottle into the lower part of the mould, the mould is closed with the embossing die by the stroke-like motion of the upper part. Finally, for generation of the pressure necessary for transfer of heat between embossing die, hot embossing foil, and the surface to be printed, the bottle is inflated, whereby work proceeds with substantial pressures of the order of around 20 bar. Through this inflation process, contact with the embossing die takes place, with the wokpiece thus being moved up to the stationary embossing die. Since the inflation pressure in the bottle naturally acts not only in the region of the embossing die, but also everywhere, the split mould must withstand this inflation pressure, and the mould must also be kept closed, which calls for application of appropriately designed hydraulic presses for the upper and lower parts. Via this inflation pressure, the tolerances in the surface shape of the hollow body occurring during its production are compensated, whereby, depending on the accuracy of bottle production, a proportion of rejects cannot be avoided. The embossing die must be produced with special matching to this production procedure so that the inflated plastic bottle engages only the projecting parts of the die element, i.e. the die surface and does not engage the other parts of the die element even under inflation pressure. After application of pressure and heat, i.e. adhesion or melting of the hot embossing foil on to the surface of the bottle in the region of the printed image, the inflation pressure is removed from the interior of the bottle, already disadvantageously resulting in a relative motion between the hot surface of the bottle with hot embossing foil and the mould, which, in the event of premature opening of the mould, may lead to a blurred and otherwise impaired printed image. At opening of the mould, a cooling time can be only restrictedly assured before the foil is already unintentionally stripped off at specific locations. Finally, the hot embossing foil is stripped or detached from the now printed surface of the workpiece and cyclically moved onwards one effective space.

A disadvantage of this procedure is that the tolerances of the hollow body are compensated by the inflation pressure to achieve necessary contact everywhere. A substantial pressure is needed to deform the bottle, such a pressure not being absolutely necessary for printing itself. For the printing process, excessive pressure may even be disadvantageous. Owing to necessary splitting of the mould, printing of such a hollow body all-round or essentially all-round is not possible in one step. The embossing angle cannot be greater than 180°. In practice, it is significantly under 180°, since precisely the surfaces lying within the limiting angle domain give rise to difficulties. Another disadvantageous feature is that the upper and lower parts of the mould must be very accurately adapted or matched to the bottle shape. The same cosmetic object in bottles of different size and/or design is frequently supplied in different quantity, with the same printed image, however, being used. It is thereby necessary to produce and to use respectively one complete mould with upper and lower parts and with embossing die. Since the embossing die is fixed relative to the upper part, the printed image is also fixed relative to the bottle to be printed. A print location modification also thus calls for production of a new mould. Also disadvantageous is the fact that, owing to occurrence of high inflation pressures, foreign bodies on the hot embossing foil passing into the region of the embossing die may lead to embossing die damage and thereby unserviceability.

The purpose of the invention is to indicate a procedure and device of the type described in the introduction, whereby it is possible to print workpieces, especially flexible hollow bodies, of quite different shape and/or different printed image location.

This is achieved according to the invention in that the embossing die, through progressive engagement over the entire die surface, is brought into contact with the workpiece, and the embossing die, at least in the region of the die surface, is thereby given a form corresponding to the shape of the workpiece. Apart from the known state-of-the-art technology, i.e. the lifting procedure, unrolling procedure, and inflation procedure, the invention opens up a further procedure which can be designated as the combined lifting/unrolling procedure. Whereas, in the state-of-the-art unrolling procedure and inflation procedure, the workpiece is moved, or, in the lifting procedure, the embossing die is moved, workpiece and embossing die are here relatively moved up to each other. The workpiece can thereby be positioned or stabilized in such a manner that it will not and cannot execute any motion. When applied in the present procedure, however, the embossing die, always designed according to the state-of-the-art as a fixed element which can be slightly compressed only in its material elasticity domain, is designed for flexibility, especially in terms of its thin-walled nature and material. This flexibility is exploited to match the embossing die up to the workpiece. The embossing die thus progressively engages the workpiece and assumes its shape during the printing process. This gives rise to the unexpected advantage that the printing procedure can be used even for the most varied workpiece shape, i.e. for round, oval, otherwise convex, flat, or also concave workpieces. It is also possible, with one and the same embossing die, to print workpieces of different shape, whereby the same printed image of course occurs. Print location modifications are completely trouble-free, since the workpiece must not be held in a mould for receipt of pressure. It is further surprising that the printing result is improved and scrap reduced, since the embossing die is better able to match the workpiece concerned during each individual printing procedure, so that the printing process is more independent of the tolerances of e.g. the plastic bottles produced in the inflation procedure. Reliability is enhanced. Since, in relation to embossing dies according to the state-of-the-art, the embossing die exhibits a very much smaller mass, it is ready to be used for the printing process after a brief warm-up time, whereby a reduction from around half an hour to one minute can here be established. Through elimination of upper and lower parts of the mould for flexible hollow bodies, adaptation of these mould parts to the special shape of the hollow body is also dispensed with. Expenditure on production of the embossing die is appreciably reduced. Also surprising for the qualified specialist is the further advantage that the embossing angle can run to 180° and more during one printing process. This represents a peculiarity for a procedure operating in stroke-like manner and opens up scope e.g. for printing of a round bottle in a single printing process via an angle of 210°. All-round printing calls for two printing processes. Further advantageous is the fact that the printing machine can be comparatively more simply designed and sized, since the high inflation pressure during printing of flexible hollow bodies is dispensed with. The bottle can in fact still be inflated if it is especially flexible, i.e. if and insofar as it appears appropriate for its stability in the fixed position. Inflation pressure is thus reduced from around 20 bar according to the state-of-the-art to e.g. 2 bar for stabilization purposes. High embossing pressure is not sought in the new procedure, since high embossing pressure is associated with the risk that e.g., under excessively long time effect, unwanted deformation of the surface to be printed will occur. The new procedure further confers the advantage that the printing process is completed in a shorter time, with less heat thereby being transferred. Especially during printing of larger surfaces, smaller sink-holes arise through the subsequent cooling process. The procedure according to the invention also confers several advantages relating to subsequent workpiece printing or processing operations. It is thus possible and cost-justifiable to provide several printing stations in one machine, since the individual printing station can be produced comparatively more cheaply. In this manner, it becomes possible to combine relief printing stations with screen printing stations in one machine and to intermatch working speeds. Embossing pressure is selected only to the extent necessary for proper deformation or application of the embossing die to the workpiece. Foreign bodies present on the hot embossing foil or those falling on to it are no longer able to make the embossing die unserviceable. The flexible embossing die permits more appropriate application at a particular location during its workpiece match-up process on the surface of the workpiece as well as engagement in a kind of unrolling process. The effect of air bubbles between hot embossing foil and workpiece surface is thereby counteracted. The hot embossing foil engages the workpiece without creases and is connected with the workpiece surface in the printed image.

Especially during printing of uneven surfaces or workpieces, the hot embossing foil is initially applied to the surface of the workpiece to be printed with application of a supporting mask and thereby fixed. Finally, the embossing die is applied to the already fixed hot embossing foil through an opening in the supporting mask. After transfer of heat from the embossing die to the hot embossing foil and the surface of the workpiece, the embossing die initially and, after a cooling time, the supporting mask are lifted off the workpiece. Application of the supporting mask is always appropriate or generally even necessary if the workpiece surface to be printed is convex or concave. Only on simple evenly produced workpieces can the supporting mask ever be missing. The major advantage of supporting mask application is that this initially at once applies the hot embossing foil to the surface of the workpiece to be printed and fixes it there. The supporting mask exhibits an opening or window through which the embossing die with its die element and especially die surface directly engages the hot embossing foil, whereas the other parts of the embossing die are able to engage the supporting mask. Through suporting mask design, the unrolling process and application of the supporting surface to the hot embossing foil can be additionally influenced. The supporting mask, however, also serves for prevention of heat transfer from the other parts of the embossing die—other than at the location of its opening or window. The embossing foil may not be heated outside the printed image, since additional unwanted impressions would here otherwise occur on the workpiece. Through application of the supporting mask, it is further possible to exploit the advantage that, before, during, and after the embossing process, the hot embossing foil can be held relative to the surface of the workpiece to be printed without slip. This allows assurance of a specific cooling time after removal of the embossing die from the surface to be printed. The printed image becomes cleaner and clearer.

For transfer of heat to the embossing die, different options are available. It is especially advantageous if heat is inductively transferred to the embossing die. The embossing die is switched into the closed secondary circuit by its metal part so that heat is directly liberated where it is used. It is only transfer of heat from the thin metal film to the thin silicone or rubber film that is necessary. Since this film can be made very thin, because high contact pressure is no longer necessary, heat conduction in the region of the die element is appreciably improved. Other heat generation and transfer options, however, are also available. For example, the embossing die with its die surface, or also at its rear, could be heated by infrared radiation, which could be executed either continuously or also during printing pauses.

During printing of flexible hollow bodies, the workpiece is mouldlessly, i.e. without application of a mould, inflated only by a pressure necessary for its stabilization. For this purpose, it is only necessary to grip the bottle in the region of the bottle neck and bottle base, i.e. opposite, and to ensure purposeful introduction of inflation air into the bottle. This inflation pressure has nothing to do with contact pressure during the printing process according to the state-of-the-art.

The device for execution of the procedure operates with one holding station for the workpiece, one cyclically operating feed device for the hot embossing foil, one embossing die movable relative to the holding station, and one heating device for the embossing die. The holding station can be designed in the simplest manner, e.g. in the shape of a table for printing of even workpieces. According to the invention, the embossing die consists of elastically deformable material and is designed in a thin-walled manner so that, at application to the workpiece to be printed, it engages its surface in an elastically deforming manner. The embossing die may consist of thin bendable sheet metal whose surface is arranged towards the die surface. It is also of course possible that the thin sheet metal, as it were, forms the basic element on which a similarly very thin die element of plastic, rubber, silicone, or the like is arranged, which, on its side facing away from the basic element, exhibits the die surface. The bendability or flexibility of the embossing die must lie within the elastic domain and be arranged so that it satisfies the individual requirements of the specific application case. It is e.g. also possible to produce the embossing die from a rubber-like metal into whose bulk metal particles are worked in the form of a lattice or the like.

Between embossing die and hot embossing foil, a supporting mask fixing these is generally provided, exhibiting an opening for passage of a die element of the embossing die carrying the die surface. This supporting mask may everywhere exhibit approximately equal wall thickness. In any case, it consists of an elastic material which, however, must be thermally insulating. At application to the workpiece, the supporting mask also assumes it surface form or else copies this. The embossing die is then formed on to the supporting mask during the printing process, whereby the die surface passes through the opening of the supporting mask and directly engages the carrier foil of the hot embossing foil. The supporting mask can also be made with purposefully different wall thickness to influence thereby the forming process or engagement process of the die surface at the workpiece. The supporting mask consists of pliable material which can be loaded under tension or compression. During printing of concave surfaces, the supporting mask must be able to be loaded under pressure, since it must apply the hot embossing foil in this region on to the workpiece. In a preferred embodiment, the embossing die consists of a die element, made of elastically flexible material, especially silicone, carrying the die surface, and a basic element made of elastically flexible sheet metal. The overall height of the embossing die may thus be of the order of 2–4 mm.

The embossing die with its sheet metal basic element may be connected in a closed, inductively heated circuit. This represents a very quick-acting and purposefully controllable heating option for the embossing die, so that its die surface can be heated very precisely with the envisaged temperature.

If separate drive devices for the supporting mask, on the one hand, and for the embossing die, on the other, are provided, this advantageously confers scope for retention of the hot embossing foil with the supporting mask without slip relative to the workpiece surface to be printed before, during, and after contact with the embossing die.

Although the invention, especially in the embodiment examples, is described for printing of workpieces made of plastic or at least with a plastic coating, i.e. synthetic lacquer, the printing procedure and device are quite generally applicable for printing of the most varied materials, such as e.g. glass, metal, cardboard, porcelain, etc.; the prerequisite is an appropriate bonding agent.

The invention will be further described and clarified on the basis of the drawings.

Figure 1:
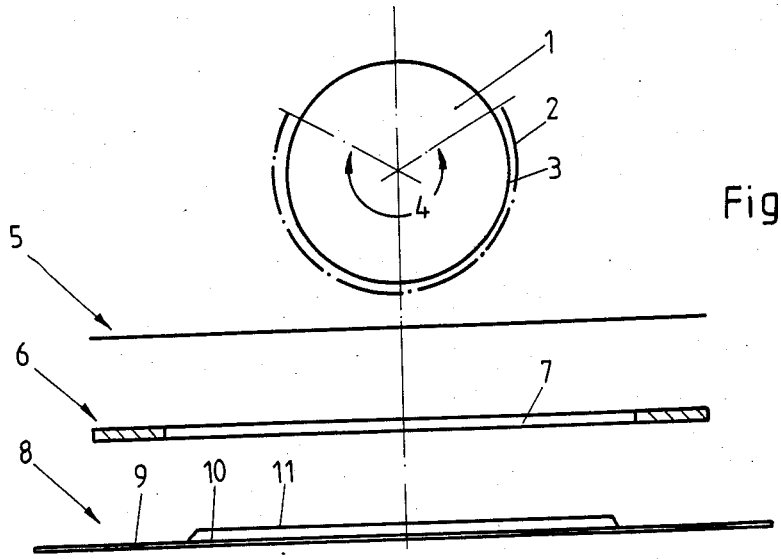
FIG. 1 shows: the relative position of the major components prior to the printing process of a workpiece with cylindrical shape.

According to FIG. 1, a workpiece 1 is to be printed with a printed image 2. Workpiece 1 has a cylindrical shape, e.g. consisting of an appropriately designed plastic bottle. Printed image 2, which is indicated by dash/-dot lining, occurs on the surface of workpiece 1 and is only indicated at some distance therefrom for the sake of clarity. In actual fact, at the end of the printing process, printed image 2 is arranged on surface 3 of workpiece 1. At this point, it is already evident that embossing angle 4 via which printed image on workpiece 1 extends is greater than 180°.

A hot embossing foil 5 of conventional structure is used. At appropriate distance from hot embossing foil 5, a supporting mask 6 is provided, consisting of elastically flexible, i.e. bendable, material, which also produces a thermally insulating effect. Supporting mask 6 exhibits an opening 7 or window, which is made slightly larger than printed image 2.

Located below supporting mask 6 is embossing die 8, which may be composed of a basic element 9, made of thin bendable sheet metal, and a die element 10, made of silicone or other plastic. On its side facing towards workpiece 1, die element 10 exhibits a die surface 11 in which the locations arranged to project determine the lining or design of printed image 2.

Figure 2:
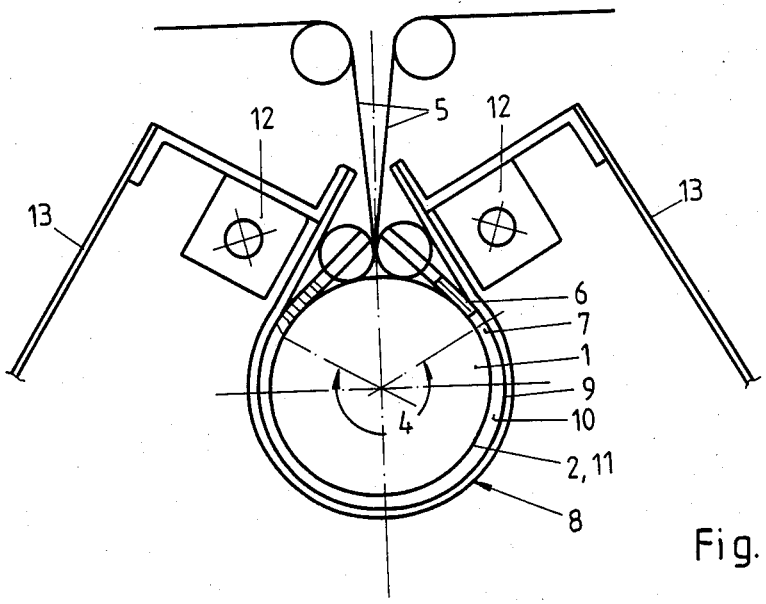
FIG. 2 shows: the relative position of the components according to FIG. 1 during the printing process.

As is evident from FIG. 2, during a printing process of workpiece 1, supporting mask 6 is initially placed around workpiece 1 in the manner represented, whereby supporting mask 7 applies hot embossing foil 5 guided via appropriate rolls on to surface 3 of workpiece 1. Hot embossing foil 5 is thereby fixed. Workpiece 1 is understandably fixed. If it is a matter of a very flexible hollow body in the form of a bottle, this can also be inflated at low pressure for stabilization purposes prior to application of the supporting mask. In a second application process, embossing die 8 is placed around workpiece 1 and supporting mask 7 held in bandage-like manner, i.e. in such a manner that die element 10 is able to pass through opening 7 of supporting mask 6 and directly engages the surface of hot embossing foil 5, i.e. in the carrier strip region. This application and engagement procedure is advisably executed and controlled in such a manner that progressive application results, i.e. initially at one location, preferably at the lowest location of the circumference, contact occurs, with the embossing die, as it were, deforming to both sides until it has exactly assumed the shape of the surface of workpiece 1 and supporting mask 6. The printing process can be executed with very low contact pressure, so that there is no danger that flexible workpiece 1 will be crushed or otherwise damaged. During the time-controlled contact time, heat from embossing die 8 is transferred to hot embossing foil 5 and also to surface 2 or workpiece 1, so that printed image 2 melts on to surface 3. This heat is e.g. inductively generated in embossing die 8 itself. The ends of embossing die 8 are arranged in a closed secondary circuit via guide elements 12 and electric lead 13. Embossing die 8 may preferably be continuously heated. Heat is generated in embossing die 8, whereas electric leads 13 and guide elements 12 remain cold. The heat arising in basic element 9 is transferred by thermal conduction into die element 10 and emitted via die surface 11. The paths are here extremely small, so that good efficiency is attainable and the surface temperature of die surface 11 can be regulated within very narrow limits. If the necessary heat has been applied and the dwell time has elapsed, embossing die 8 is first removed from workpiece 1 and supporting mask 6, whereby supporting mask 6 further retains hot embossing foil 5 on workpiece 1 without slip.

After expiry of the necessary cooling time, supporting mask 6 is also swivelled back into its position of rest evident from FIG. 1, whereby hot embossing foil 5 or its carrier strip is detached from printed image 2, which is now fixed on surface 3 of workpiece 1. Hot embossing foil 5 is moved onwards one effective space, and a new object 1 can be subjected to the printing process.

Figure 3:
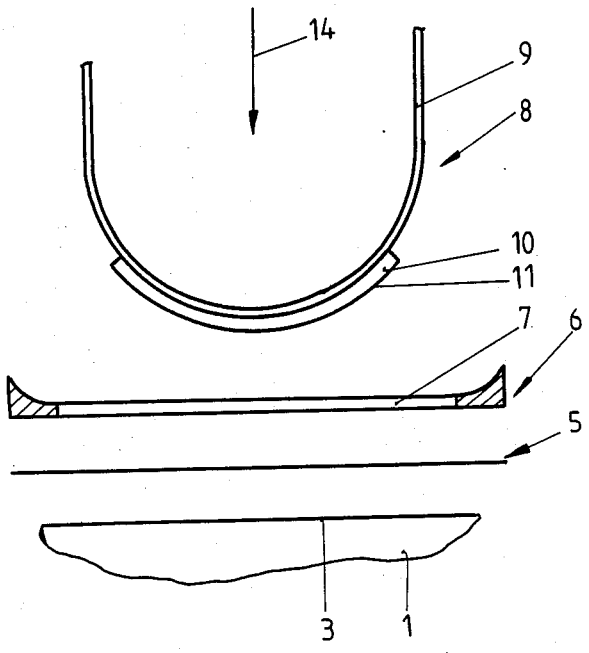
FIG. 3 shows: the relative position of the components prior to the printing process of an even workpiece.
Figure 4:
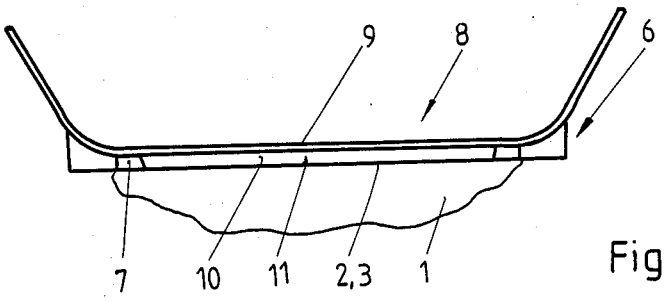
FIG. 4 shows: the relative position of the components according to FIG. 3 during the printing process.

The printing process on surface 3 of an uneven workpiece 1 is evident from FIGS. 3 and 4. Embossing die 8 is here structured exactly as in the embodiment example of FIGS. 1 and 2. It may even be a matter of identical embossing die 8, so that the same printed image 2 also occurs on workpiece 1. In this case, it is also possible to work without application of supporting mask 6, if it is ensured that only die surface 11 engages surface 3 of workpiece 1 via hot embossing foil 5. This can be accomplished through purposeful control of the lifting process of embossing die 8 according to arrow 14. It is evident from FIG. 4 that supporting mask 6 can also be made with different wall thickness to affect the unrolling process of embossing die 8. This unrolling process also begins here in the centre of die surface 11 and continues to both sides, whereby, finally, basic element 9 engages supporting mask 6 and is retained.

Figure 5:
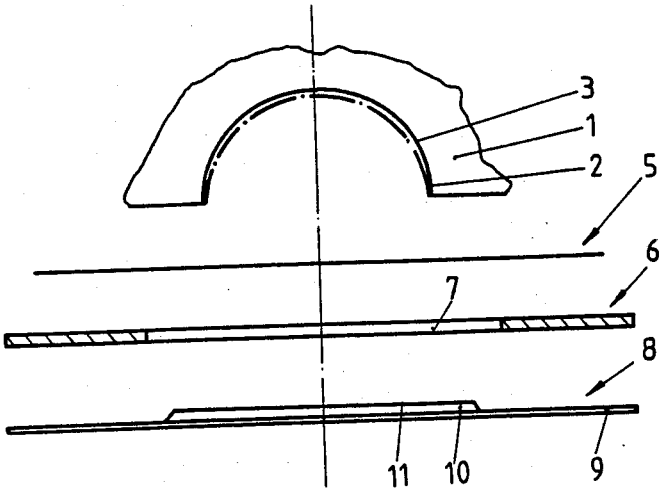
FIG. 5 shows: the relative position of the components prior to the printing process of a concave workpiece.
Figure 6:
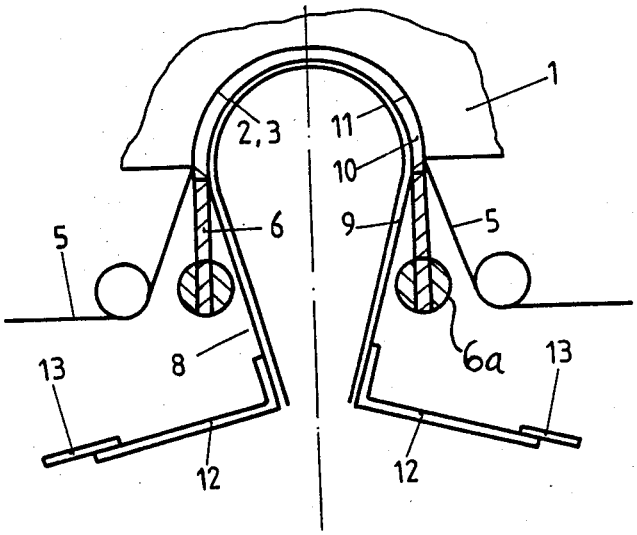
FIG. 6 shows: the relative position of the components according to FIG. 5 during the printing process.

FIGS. 5 and 6 show an embodiment example for printing of a workpiece 1 with a concave surface 3 on which printed image 2 is to be arranged. It is evident here that supporting mask 6 (FIG. 6) must be able to be loaded under pressure, since it applies hot embossing foil 5 to concave surface 3 of workpiece 1. The same applies to embossing die 8. Structure and operating mode, however, are otherwise similar or identical. Supporting mask 6 has a drive device **6*a* separate from the drive device for die 8**.

It is evident from all embodiment examples that one and the same embossing die 8 is applicable for printing of the most differently shaped surfaces 3 of workpiece 1. Even a print location modification, i.e. if printed image 2 is to be arranged higher up or lower down on a bottle, is quite simply possible. For this purpose, neither a new embossing die 8 nor a new supporting mask 6 must be made. The relative position to workpiece 1 is much more simply modified or set.

Figure 7:
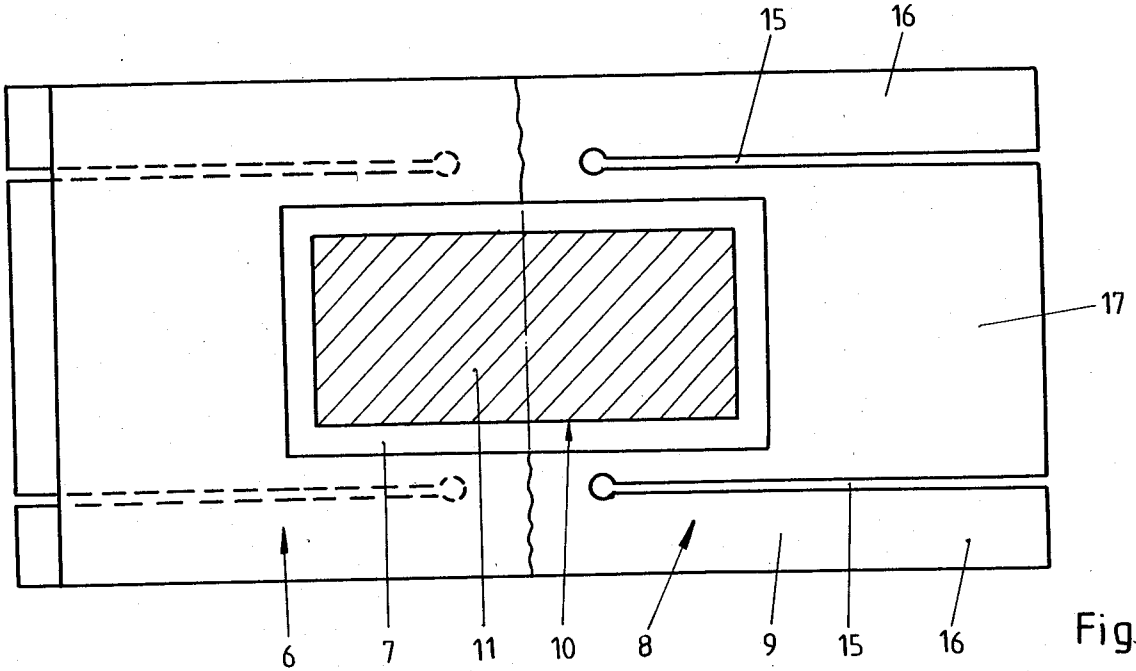
FIG. 7 shows: a partly sectioned plan view of a supporting mask and embossing die.

FIG. 7 shows a plan view of supporting mask 6 in the LH part, whereas, in the RH part of the illustration, embossing die 8 located below is recognizable. Supporting mask 6 may e.g. consist of asbestos or be coated therewith. Basic element 9 of embossing die 8 may be equipped with incisions arranged outside die element 10 in such a manner that embossing element 8 is subdivided in the edge zone into three parts. The thereby divided tongues 16 serves to affect the forming or engagement process of embossing die 8 on surface 3 of the workpiece and are not placed around workpiece 1. Only central part 17 is thereby covered by guide elements 12 and placed around workpiece 1. Die surface 11 thereby initially achieves contact at its centre or according to the axis of symmetry with workpiece 1 or hot embossing foil 5, whereas the other zones engage in symmetrical arrangement. This special design of embossing die 8 is thus important for this engagement or forming process of embossing die 8 on workpiece 1, i.e. in respect of the time response.

I claim:

1. Apparatus for dry printing on a workpiece comprising: a hot embossing die with embossing foil to be moved relatively against a workpiece; said die being brought into progressive contact with the workpiece over the entire die surface so that said die acquires a shape conforming to the shape of the workpiece; means for holding said hot embossing die with said foil in contact with said workpiece over a predetermined time interval to transfer heat from said die and foil thereby, said die being moved thereafter away from said workpiece while leaving said foil adhered to said workpiece, said foil being detached from said workpiece after a predetermined cooling time while leaving a printed image on the workpiece; a holding station for the workpiece; a cyclically operating feed means for feeding hot embossing foil to said holding station; said embossing die being movable relative to said holding station; means for heating said embossing die; said embossing die comprising elastically deformable material and having a thin wall for engaging the workpiece surface in an elastically deforming manner; a supporting mask between said embossing die and said hot embossing foil for fixing in place said die and said foil; said mask comprising pliable material subjectable to tension and compression; said die comprising further a die element of elastically flexible and temperature-resistant material in form of silicone carrying a die surface, and a base element of elastically flexible sheet metal; said die with base element of sheet metal being connected in a closed inductively heated circuit; and means for driving said supporting mask, said driving means being separate from drive means for said embossing die.

2. Apparatus for dry printing on a workpiece comprising: a hot embossing die with embossing foil to be moved relatively against a workpiece; said die being brought into progressive contact with the workpiece over the entire die surface so that said die acquires a shape conforming to the shape of the workpiece; means for holding said hot embossing die with said foil in contact with said workpiece over a predetermined time interval to transfer heat from said die and foil thereby, said die being moved thereafter away from said workpiece while leaving said foil adhered to said workpiece, said foil being detached from said workpiece after a predetermined cooling time while leaving a printed image on the workpiece; a holding station for the workpiece; a cyclically operating feed means for feeding hot embossing foil to said holding station; said embossing die being movable relative to said holding station; means for heating said embossing die; said embossing die comprising elastically deformable material and having a thin wall for engaging the workpiece surface in an elastically deforming manner; a supporting mask between said embossing die and said hot embossing foil for fixing in place said foil.

3. Apparatus as defined in claim 2, wherein said supporting mask comprises pliable material that can be subjected to tension and compression.

4. Apparatus as defined in claim 2, including drive means for said supporting mask, said drive means being separate from drive means for said embossing die.

5. Apparatus for dry printing on a workpiece comprising: a hot embossing die with embossing foil to be moved relatively against a workpiece; said die being brought into progressive contact with the workpiece over the entire die surface so that said die acquires a shape conforming to the shape of the workpiece; means for holding said hot embossing die with said foil in contact with said workpiece over a predetermined time interval to transfer heat from said die and foil thereby, said die being moved thereafter away from said workpiece while leaving said foil adhered to said workpiece, said foil being detached from said workpiece after a predetermined cooling time while leaving a printed image on the workpiece; a holding station for the workpiece; a cyclically operating feed means for feeding hot embossing foil to said holding station; said embossing die being movable relative to said holding station; means for heating said embossing die; said embossing die comprising elastically deformable material and having a thin wall for engaging the workpiece surface in an elastically deforming manner; said embossing die comprising further a die element of elastically flexible and temperature-resistant material in form of silicone carrying a die surface; and a base element of elastically flexible sheet metal.

6. Apparatus as defined in claim 5, wherein said embossing die with base element of sheet metal is connected in a closed inductively heated circuit.

7. A method for dry printing on a workpiece, comprising the steps of: moving a working piece and a hot flexible embossing die with embossing foil relatively against each other; bringing said die in progressive contact with the workpiece over the entire die surface and imparting to said die a shape conforming to the shape of the workpiece; clamping for a predetermined time interval said hot embossing die against the workpiece and holding said embossing foil in contact with said workpiece to transfer heat from said die and foil thereby; moving said die away from said workpiece and leaving said foil adhered to the workpiece; and detaching said foil from said workpiece after a predetermined cooling time while leaving a printed image on the workpiece, workpieces of different shapes being printable with the same die, said die applying pressure only over the printed image surface, said progressive contact of said die with said workpiece preventing entrapment of air, said die being heated from within, said printed image occurring at the instant of progressive contact of contours of said die with said foil and being transmitted simultaneously to the workpiece, said die carrying said image and applying said image first to a coated surface of said foil.

8. A method as defined in claim 7, including the step of inserting a supporting mask with an opening so that said die is applied to the workpiece surface through said supporting mask and fixing said foil in place; applying a die element of said die to said fixed hot embossing foil through said opening in said supporting mask; and lifting said supporting mask off said workpiece after transferring heat from said die to said foil and the workpiece surface and after elapse of a predetermined cooling time interval.

9. A method as defined in claim 7, including the step of inflating moldlessly a flexible hollow body comprising said workpiece with a pressure required for stabilization during printing.

10. Apparatus for dry printing on a workpiece comprising: a hot embossing die with embossing foil to be moved relatively against a workpiece; said die being brought into progressive contact with the workpiece over the entire die surface so that said die acquires a shape conforming to the shape of the workpiece; means for holding said hot embossing die with said foil in contact with said workpiece over a predetermined time interval to transfer heat from said die and foil thereby, said die being moved thereafter away from said workpiece while leaving said foil adhered to said workpiece, said foil being detached from said workpiece after a predetermined cooling time while leaving a printed image on the workpiece; a holding station for the workpiece; a cyclically operating feed means for feeding hot embossing foil to said holding station; said embossing die being movable relative to said holding station; means for heating said embossing die; said embossing die comprising elastically deformable material and having a thin wall for engaging the workpiece surface in an elastically deforming manner; workpieces of different shapes being printable with the same die, said die applying pressure only over the printed image surface, said progressive contact of said die with said workpiece preventing entrapment of air, said die being heated from within, said printed image occurring at the instant of progressive contact of contours of said die with said foil and being transmitted simultaneously to the workpiece, said die carrying said image and applying said image first to a coated surface of said foil.

* * * * *